US010965033B2

(12) United States Patent
Petros

(10) Patent No.: US 10,965,033 B2
(45) Date of Patent: Mar. 30, 2021

(54) ADAPTIVE-SPACING ANTENNA

(71) Applicant: Taoglas Group Holdings Limited, Enniscorthy (IE)

(72) Inventor: Argy Petros, Coconut Creek, FL (US)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 268 days.

(21) Appl. No.: 16/191,325

(22) Filed: Nov. 14, 2018

(65) Prior Publication Data

US 2020/0153101 A1 May 14, 2020

(51) Int. Cl.

| | |
|---|---|
| ***H01Q 1/36*** | (2006.01) |
| ***H01Q 9/28*** | (2006.01) |
| ***H01Q 1/38*** | (2006.01) |
| ***H01Q 21/00*** | (2006.01) |
| ***H01Q 21/06*** | (2006.01) |
| ***H01Q 1/44*** | (2006.01) |

(52) U.S. Cl.
CPC ..... *H01Q 9/28* (2013.01); *H01Q 1/38* (2013.01); *H01Q 1/44* (2013.01); *H01Q 21/0006* (2013.01); *H01Q 21/062* (2013.01)

(58) Field of Classification Search
CPC ..... H01Q 9/28; H01Q 1/38; H01Q 21/0006; H01Q 21/062; H01Q 1/44; H01Q 1/288; H01Q 15/168; H01Q 1/243; H01Q 15/141; H01Q 1/007; H01Q 1/36
See application file for complete search history.

(56) References Cited

U.S. PATENT DOCUMENTS

| | | | | |
|---|---|---|---|---|
| 6,188,370 | B1 * | 2/2001 | Lange | H01Q 15/16 343/840 |
| 7,511,675 | B2 | 3/2009 | Puente-Baliarda et al. | |
| 2007/0200790 | A1 * | 8/2007 | Bassily | H01Q 15/161 343/915 |
| 2012/0287017 | A1 * | 11/2012 | Parsche | H01Q 1/243 343/897 |

OTHER PUBLICATIONS

J.G. Sverak, "Optimized Grounding Grid Design Using Variable Spacing Technique", IEEE Transactions on Power Apparatus and Systems (vol. 95, No. 1, Jan. 1976).

* cited by examiner

*Primary Examiner* — Dameon E Levi
*Assistant Examiner* — David E Lotter
(74) *Attorney, Agent, or Firm* — Garson & Gutierrez, PC

(57) ABSTRACT

Disclosed is an adaptive-spacing antenna system and a method for designing an adaptive-spacing antenna system. The antenna system and design method are operative to provide a configuration layout that reduces both the amount of material required to manufacture the antenna and the obtrusiveness caused by the antenna, while providing more flexibility for installation and a variety of options for aesthetic applications. The adaptive-spacing antenna comprises one or a combination of more than one set of straight-linear and curvilinear elements forming an adaptively-spaced grid or mesh structure. The system and method are particularly suitable for reducing the antenna weight, cost, and obtrusiveness during operation.

17 Claims, 7 Drawing Sheets

ADAPTIVE-SPACING ANTENNA

FIELD OF THE INVENTION

The present invention relates to antenna systems and methods. More particularly, the present invention relates to antenna systems and to antenna system design methods for overcoming adverse effects caused by obtrusiveness, weight, and bulkiness of the structure of antenna systems during the operation of such systems.

BACKGROUND OF THE INVENTION

A number of electronic communication devices and systems exist for enabling a user to operate these devices and access services for multiple applications. Usually one or more antennas are required to support such operations. A conformal, unobtrusive and preferably hidden, antenna system configuration is a key element to facilitate these operations and to increase the aesthetic appeal of the system. However, antennas made of single piece of solid, non-transparent material are typically heavier, bulkier, and require more material than meshed counterparts. It is well-known in the prior art that a good approximation to a solid conductive material can be obtained by meshing or gridding the solid material into wires, strips, and/or plates. However, a uniform gridding or meshing of an antenna made of a single piece of solid material tends to overdesign the grid antenna, especially for wideband antennas, as the minimum gridding spacing required varies depending on the antenna frequencies of operation and polarization characteristics.

In particular, antenna applications where unobtrusiveness, aesthetics, amount of conductive material used, physical dimensions, or weight are essential may benefit from an adaptively-spaced grid antenna. For example, antennas used in spacecrafts and space probes are typically required to be small, conformal, and light-weight; moreover to avoid corrosion and oxidation some of these antennas may be made of gold or other expensive conductive materials. Thus, the use of a lower amount of material may be important as long as the tradeoff required for a reduction in antenna gain is justifiable. Likewise, radio, Internet, or TV antennas mountable in transparent substrates, including a glass portion of buildings as well as house and car windows would definitely demand an aesthetically appealing, non-obtrusive antenna.

Normally the antenna system is configured to operate while physically mounted on a communication device where the available area for antenna placement might be limited. This situation becomes more critical for antenna applications used in unmanned aerial systems and handheld electronic devices, such as phones, tablets, and computers, in which the antenna inherently occupies a relatively large area of the mounting platform. Likewise for High-Definition TV and other applications operating at certain frequency bands, such as VHF/UHF or lower, where the size of the antenna might be in the order of several feet, the location of an unobtrusive antenna becomes a challenge and aesthetically unappealing.

Accordingly, the design, aesthetics, and operational characteristics of a handheld electronic communications device and the implementation of certain applications on aerial platforms and even at home may be severely restricted. However, meshed or gridded antennas are typically less obtrusive, lighter-weight, and may be less costly as compared to their antenna counterparts made of a single piece of solid material due to the use of a smaller amount of material.

Recently, the demand for lighter-weight, less bulky antennas has increasingly grown for multiple applications in the wireless communications and aerospace industries, especially for portable electronic devices and unmanned aerial vehicles. Previous efforts have been made to implement grid antennas and methods with efficient grid spacing, as described in U.S. Pat. No. 6,188,370 to M. J. Lange and in an article by J. G. Sverak published in the IEEE Transactions on Power Apparatus and Systems (Vol. 95, No. 1, January 1976).

However, these efforts include the adjustment of spacing between conductive elements to achieve a specific performance of an antenna reflector or a meshed grounding system, respectively. A major limitation of these approaches occurs where the actual radiating elements need to be optimally spaced to simultaneously reduce obtrusiveness, weight, costs, amount of material used, while maintaining a pre-determined antenna performance and providing the opportunity of an aesthetically appealing configuration.

More specifically, Lange proposes a parabolic reflector comprising a plurality of conductive elongate elements which are spaced apart by different spacing to realize a predefined signal reflection at certain angles. On the other hand, Sverak proposes a variable spacing technique limited to optimize the grounding grid design of meshed ground planes using a recursive point by point integration of gradients of earth surface potential curves.

Typically, meshing conductive materials that are part of an antenna affects the performance of an identical antenna made of solid—not meshed—conductive materials. The most common positive effects include a slight increase in bandwidth and cross-polarization, a reduction of the resonant frequency, amount of conductive material required, and weight as well as a significant improvement in optical transparency. However, on the negative side, the antenna gain and the front-to-back antenna radiation might be reduced, and the antenna losses be moderately increased. In general the denser the mesh the lesser the impact, so there is a number of tradeoffs to account for in determining if and by how much a solid conductor should be uniformly meshed for certain applications.

More specifically, other attempts made to implement antenna solutions to reduce the size, obtrusiveness, and amount of material used have become partly successful and entail larger complexity and cost, narrow operational bandwidth, or are restricted to applications in a limited number of frequency bands. Some of these additional efforts that have been made to develop an antenna system using a combination of conductive linear elements are described in U.S. Pat. No. 7,511,675 to Puente-Baliarda, et al. This document discloses an antenna comprising a space-filling geometry with at least two hundred segments, each of them having a length less than one-hundredth of the free-space operating wavelength for various automotive applications in the FM, GPS, and cellular frequency bands. However, these efforts have faced certain challenges and limitations. A limitation of this approach is that for applications in which the wavelength is small, the size of the antenna elements may become impractically small. Another limitation of this approach is that the antenna is inherently narrow band, resulting in a restriction for using the antenna for wideband applications. As a result, this approach may not only be more costly, because of more complex manufacturing requirements, but also may not be suitable for a large number of applications.

Moreover, for certain applications, a set of conductive elements not necessarily forming a mesh may be arranged to approximate an antenna made of a single piece of solid conductive material. More specifically, based on the mode of propagation to be excited on an antenna made of solid material, a set of conductive elements following the patterns of the electrical current may replace the solid conductive material. For example, in a linearly-polarized antenna application, wherein currents flow along a linear direction over a solid conductive material according to an excited mode of propagation, a set of conductive linear elements disposed substantially parallel and aligned along the current path may be used to replace the solid material, as long as the separation between two adjacent elements, within the solid material being approximated, is in the order of approximately ten percent of a wavelength corresponding to the maximum frequency (minimum wavelength) of operation of the antenna.

An approach to tackle the disadvantages of the prior art is to adaptively space multiple linear antenna elements in a configuration that resembles the shape and attains similar performance as an antenna made of a single piece of solid material. The adaptive-spacing antenna may be integrated as part of the original design of an electronic device design or added on aftermarket.

Currently, there is no well-established method of deterministically creating an adaptive-spacing antenna design. Thus, there remains a need in the art for antenna designs and methods to develop and implement adaptively-spaced antennas that are capable of a robust operation for multiple applications, while avoiding the problems of prior art systems and methods.

SUMMARY OF THE INVENTION

An adaptive-spacing antenna system and a method for designing an adaptive-spacing antenna system are disclosed herein. One or more aspects of exemplary configurations of the adaptive-spacing antenna and design method thereof provide advantages while avoiding disadvantages of the prior art. The antenna system and design method are operative to provide a configuration layout that reduces both the amount of material required to manufacture the antenna and the obtrusiveness caused by the antenna, while providing more flexibility for installation and a variety of options for aesthetic applications. The adaptive-spacing antenna comprises one or a combination of more than one set of straight-linear and curvilinear elements forming an adaptively-spaced grid or mesh structure. The system and method are particularly suitable for reducing the antenna weight, cost, and obtrusiveness during operation.

In general, an antenna made of a single piece of solid material is heavier, bulkier, more obtrusive, and requires a larger amount of material to be made than a meshed or gridded antenna counterpart. Typical approaches to implement a lighter-weight, less obtrusive antenna include uniform gridding of a solid conductive material or the use of transparent conductive films. These solutions require more amount of material than the minimum needed for achieving a similar antenna performance or the use of more expensive components that result in increased cost, weight, and obtrusiveness of the antenna system. Other approaches use specialized high-permittivity dielectric materials or metamaterials to reduce the size of the antenna at a significant larger cost.

The adaptive-spacing antenna system disclosed herein is designed to reduce the weight, bulkiness, amount of material used, and obtrusiveness when the antenna is operating in a constrained environment. An arrangement using the antenna subject of the present invention is structured by coupling multiple linear elements such that a layout of such antenna renders a less obtrusive, more aesthetic, lighter weight, and more cost-effective antenna and increases the possible locations where to install such antenna.

The antenna comprises a set of external straight-linear and/or curvilinear elements, which define a periphery typically resembling that of an antenna made of a single piece of solid material, such as a bowtie antenna. Within the periphery defined by the external elements, a set of inner straight-linear and/or curvilinear elements are adaptively spaced to attain the above-mentioned advantages, while maintaining an antenna performance comparable to that of the resembled antenna. Moreover, the adaptive-spacing antenna system may be added on to an existing platform or integrated as part of the original design of a device or system design.

The subject of the present invention also comprises a method for designing an adaptive-spacing antenna. An antenna designed according to the method described herein is able to significantly reduce the obtrusiveness, cost, and weight of such antenna and become more environmentally friendly, while not significantly affecting or potentially improving the performance of such antenna or a device which operates using such antenna. The method enables the design of an adaptive-spacing antenna to provide a configuration and positioning of straight-linear and/or curvilinear elements that reduce the amount of material used, as compared to a single-piece solid antenna, a uniformly-spaced grid antenna, or equivalent antennas.

The configuration of the dimensional and positional parameters of the elements of the adaptive-spacing antenna includes the step of identifying the location and key operational conditions in which an equivalent antenna, made of a single piece of solid conductive material will operate. The method further includes the steps of uniformly gridding and then adjusting the dimensions and spacing of the antenna elements, according to an adaptive profile, while confirming that the performance of the dimensionally-adjusted antenna is acceptable. These elements may be selected, shaped, dimensioned, and positioned to provide the most suitable configuration for the intended application of the antenna system, in terms of performance or other predetermined criteria, corresponding to a specific application or the antenna mounting platform. The method determines dimensional and operational parameters of the elements of the adaptive-spacing antenna, such as the relative positioning of each element.

The adaptive-spacing antenna and design method thereof are able to provide a robust and aesthetic antenna layout along with a potential reduction of obtrusiveness, cost, weight, and amount of material used, as compared to designs using standard techniques, by integrating an adaptively-spaced profile for the antenna elements. This results in antenna designs that meet or exceed challenging industry standards, in terms of antenna performance for multiple applications.

BRIEF DESCRIPTION OF THE DRAWINGS

The numerous advantages of the present invention may be better understood by those skilled in the art by reference to the accompanying drawings in which.

DESCRIPTION

The following description of particular embodiments of the invention is set out to enable one to practice an implementation of the invention and is not intended to limit the invention to any specific embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
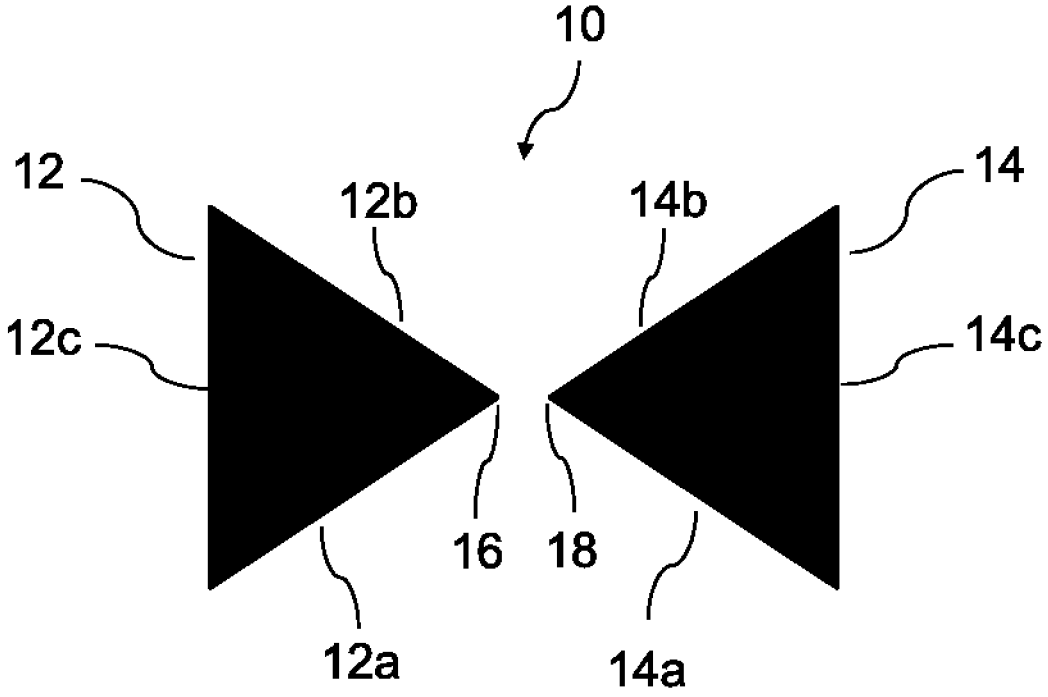
(PRIOR ART) Figure 1
FIG. 1 shows a top view of a planar bowtie antenna made of a solid, non-transparent material.

One typical example of a wideband planar antenna is the bowtie antenna. FIG. 1 shows a top view of a planar bowtie antenna 10, made of a solid, non-transparent material, as well known in the prior art. Antenna 10 consists of a first triangular-shaped arm 12 and a second triangular-shaped arm 14. Arms 12 and 14 are fed at feeding point terminals 16 and 18 and built with a solid, triangular-shaped conductive material such as copper, silver, or aluminum. Arm 12 consists of sides 12*a*, 12*b*, and 12*c*, whereas arm 14 consists of sides 14*a*, 14*b*, and 14*c*. Typically arm 12 and arm 14 have identical dimensions and each has a periphery defining an isosceles triangle. As such, sides 12*a*, 12*b*, 14*a*, and 14*b* have the same length. Likewise, sides 12*c* and 14*c* have identical length, usually different than the length of sides 12*a*, 12*b*, 14*a*, or 14*c*.

Antenna 10 may be used in multiple applications including radio, TV, and other communication systems. However, the use of antenna 10 is limited to applications wherein its installation does not create obtrusiveness or results unaesthetic. More specifically, installing antenna 10 in a transparent substrate, such as glass or plastic, might not be possible due to the nature of antenna 10 being made of a solid, non-transparent material. Those skilled in the art will realize that most planar antennas comprising a section of a solid, non-transparent material that results obtrusive or aesthetically unappealing may also be restricted for being installed in a transparent substrate.

Figure 2:
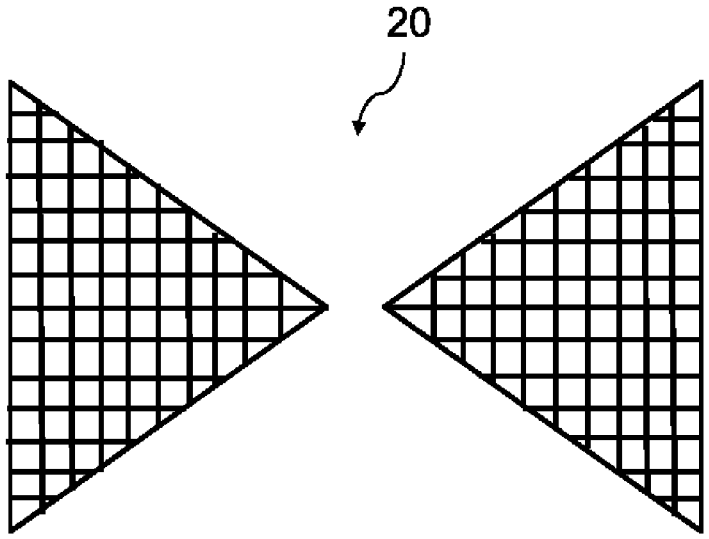
(PRIOR ART) Figure 2
FIG. 2 shows a top view of a planar bowtie antenna made of a uniform grid of a material.

The use of conductive elements, such as wires, plates, and thin lines may be used to create a mesh or grid resembling the shape of an antenna made of a solid conductive material. The meshed antenna may exhibit a similar performance to that of the antenna made of a solid conductive material, as known in the prior art. Additionally, as a rule of thumb for most antenna applications, the spacing between adjacent parallel elements forming the grid should be no larger than 10% of a wavelength corresponding to the maximum frequency (minimum wavelength) of operation of the antenna. Likewise, the width of the lines forming the grid, should be in the order of at least 0.01% of the wavelength corresponding to the minimum frequency (maximum wavelength) of operation of the antenna. FIG. 2 shows a top view of a planar bowtie antenna 20 made of a uniform grid of constant-width thin lines of conductive material.

Figure 3:
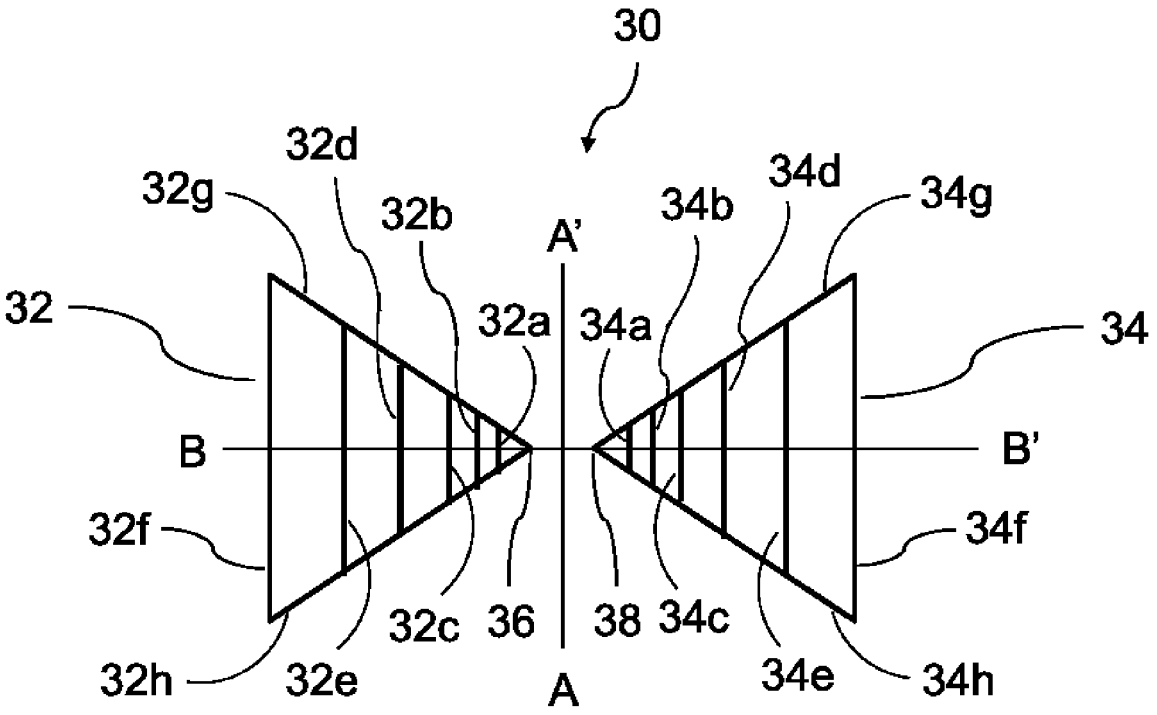
FIG. 3 shows a top view of a planar bowtie antenna made of a non-uniform, adaptive-spacing set of linear elements.

In accordance with certain aspects of a configuration of the invention, a top view of a planar bowtie antenna 30 made of a non-uniform, adaptive-spacing set of elements is shown in FIG. 3. Antenna 30 consists of a first triangular-shaped arm 32 and a second triangular-shaped arm 34. Arms 32 and 34 are fed at feeding point terminals 36 and 38 and built with a set of elements made of conductive material such as copper, silver, or aluminum. Arm 32 comprises a first set of linear elements 32*a*, 32*b*, 32*c*, 32*d*, 32*e*, and 32*f* and a second set of linear elements 32*g* and 32*h*. Elements 32*g* and 32*h* are electrically coupled to elements 32*a* to 32*f* Similarly, arm 34 comprises a third set of linear elements 34*a*, 34*b*, 34*c*, 34*d*, 34*e*, and 34*f* and a fourth set of linear elements 34*g* and 34*h*. Elements 34*g* and 34*h* are electrically coupled to elements 34*a* to 34*f*.

In this configuration, elements 32*f*, 32*g*, and 32*h* define the periphery and constitute edge elements of arm 32, whereas elements 32*a*, 32*b*, 32*c*, 32*d*, and 32*e* constitute inner elements of arm 32, circumscribed within the periphery defined by edge elements 32*f*, 32*g*, and 32*h*. Similarly, elements 34*f*, 34*g*, and 34*h* define the periphery and constitute edge elements of arm 34, whereas elements 34*a*, 34*b*, 34*c*, 34*d*, and 34*e* constitute inner elements of arm 34, circumscribed within the periphery defined by edge elements 34*f*, 34*g*, and 34*h*.

In particular, first set of elements 32*a* to 32*f* and third set of elements 34*a* to 34*f*, are disposed substantially parallel to an imaginary linear axis AA' and substantially parallel between each other. As a result, antenna 30 would be suited to operate linearly polarized along the direction of imaginary axis AA'. Elements 32*a* to 32*f* have different lengths and are arranged such that the shortest element 32*a* is the closest to feed point 36, then elements 32*b* to 32*f* are disposed in order of increasing length, such that the longest element 32*f* is the farthest from feed point 36. Linear elements 32*g*, 32*h* have the same length and each is connected at a first end to feed point 36 and at a second end to element 32*f*, such that a first end of element 32*f* connects to the second end of element 32*g* and a second end of element 32*f* connects to the second end of element 32*h*.

Furthermore, the length of elements 32*b*, 32*c*, 32*d*, and 32*e* is such that each connects at a first end to element 32*g* and at a second end to element 32*h*. As a result, edge elements 32*f*, 32*g*, and 32*h* define the periphery of arm 32 as an isosceles triangle. Likewise edge elements 34*f*, 34*g*, and 34*h* define the periphery of arm 34. Preferably, arm 34 is identical to arm 32. More preferably, arm 34 is disposed as a mirror image of arm 32 along imaginary axis AA', which is substantially parallel to elements 32*f* and 34*f* and as such disposed equidistant from feed points 36 and 38.

In general, a length of arm 32, corresponding to the distance from feed point 36 to the location of element 32*f*, is directly proportional to the intended wavelength of operation of antenna 30. Likewise, a length of arm 34, corresponding to the distance from feed point 38 to the location of element 34*f*, is directly proportional to the intended wavelength of operation of antenna 30. Thus, the required length of arms 32, 34 would be larger for a smaller operating frequency. However, for wideband antennas such as antenna 30, the size of arms 32, 34 is defined based on the minimum frequency (maximum wavelength) of operation. As a result, the effective resonating length of arms 32, 34 is smaller as the frequency of operation of antenna 30 increases.

Importantly, in a conventional implementation of linear elements uniformly spaced to approximate an antenna made of a solid conductive material, the spacing between elements is defined based on the maximum frequency (minimum wavelength) of operation of such antenna. Thus, for lower frequencies of operation, the resulting spacing between elements is smaller than the minimum required. On the other hand, the use of a non-uniform, adaptive spacing between any two adjacent elements 32*a* to 32*f* and any two adjacent elements 34*a* to 34*f*, as shown in FIG. 3, enables an arrangement having elements more distantly spaced as these elements get farther from feed points 36, 38.

In other words, the smallest spacing, corresponding to the maximum frequency of operation, may apply only to a section of the length of arms 32, 34, wherein the effective resonating length is the smallest. As the frequency of operation of antenna 30 decreases (wavelength increases), the required spacing between elements may also increase without significantly affecting the performance of antenna 30. As a result, the overall number of linear elements and the amount of conductive material required to approximate a solid conductive material may be significantly reduced compared to using a set of uniformly spaced elements. FIG. 3 shows a set of twelve elements 32*a* to 32*f* and 34*a* to 34*f* for illustration purposes. However, the actual number of linear elements required will depend on both the maximum frequency and the minimum frequency of operation of antenna 30.

A non-uniform, adaptive spacing between antenna elements may be optimized based on a set of performance factors including the amount of conductive material to be used, structure where the antenna would be installed, and a number of antenna parameters such as gain, input impedance, polarization, radiation efficiency, sidelobes level, beamwidth, front-to-back ratio, radiation pattern at specific directions, dimensions, configuration, and layout within a frequency band of interest. Thus, one or more of these factors may be considered to design and implement an antenna that meets a specific set of requirements or a performance criteria as compared to a corresponding antenna made of solid material.

In a preferred configuration, the non-uniform, adaptive spacing follows a predetermined variable spacing according to a mathematical representation suitable to provide an expected antenna performance and to facilitate an antenna implementation process. As such, a monotonically increasing profile of a spacing between adjacent antenna elements 32*a* to 32*f* as the distance from feed point 36 to antenna elements 32*a* to 32*f* increases, may be determined. Likewise, an identical profile applies to a spacing between antenna elements 34*a* to 34*f* The mathematical representation of the spacing profile may include one portion or a combination of more than one portions of a polynomial, sinusoidal, raised-cosine, Kaiser, Hamming, Bartlett, Gaussian, Hanning, Blackman, or Flat-top functions. As a first approximation, the spacing of antenna elements closer to feed points 36, 38 and within the effective resonating length of arms 32, 34, corresponding to the maximum frequency of operation, remains uniform, defining a Flat-top spacing profile.

Preferably, an optimized spacing profile may be determined according to an experimental optimization process from scratch or by a physical adjustment of the location of elements 32*a* to 32*f* or elements 34*a* to 34*f*, based on an initial mathematical profile of the spacing between elements. More preferably, the optimized spacing profile is determined with support of a computational simulation tool, such as a commercially available electromagnetic software.

In an alternative configuration, antenna 30 may comprise linear elements disposed only substantially parallel to an imaginary linear axis BB' and substantially parallel between each other. As a result, antenna 30 would be suited to operate linearly polarized along the direction of imaginary axis BB'. In yet another configuration, antenna 30 may comprise a first set of linear elements disposed both substantially parallel to imaginary linear axis AA' and substantially parallel between each other, and a second set of linear elements substantially parallel to imaginary linear axis BB' and substantially parallel between each other. As a result, antenna 30 may comprise a grid of linear elements either substantially parallel or substantially perpendicular between each other, facilitating the operation of antenna 30 in any polarization, although preferably suited to operate linearly polarized along the direction of either imaginary axis AA' or the direction of imaginary axis BB'.

Figure 4A:
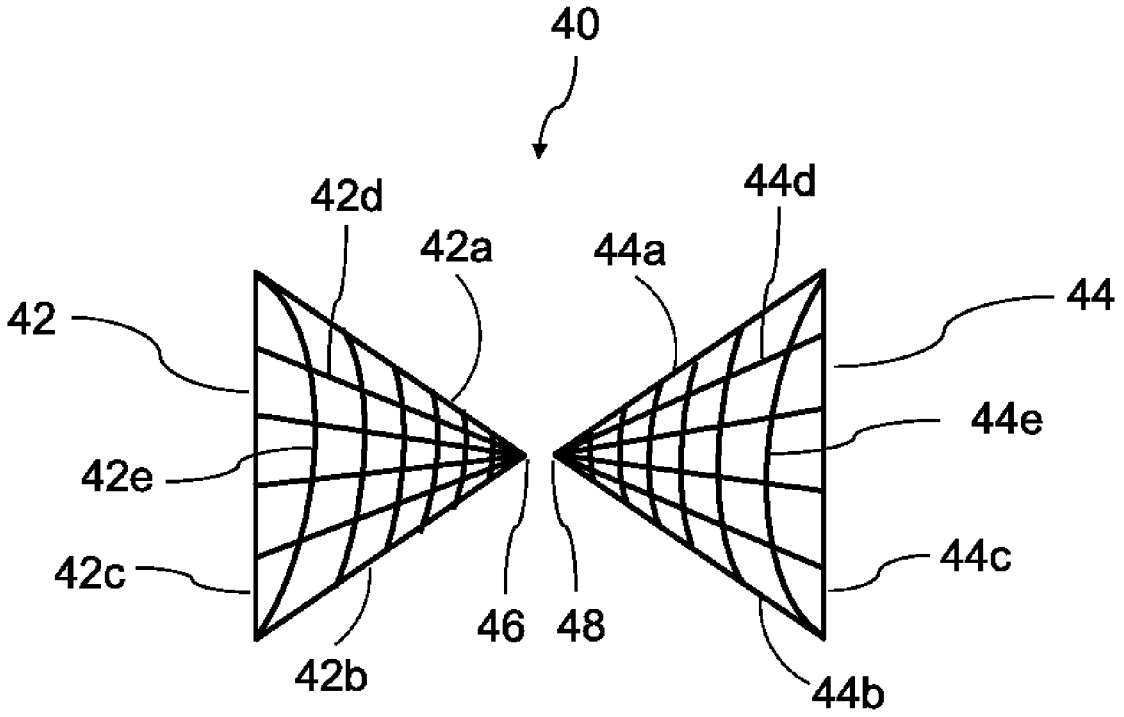
FIGS. 4A to 4C show various aspects of a planar bowtie antenna made of different types of linear elements.
Figure 4B:
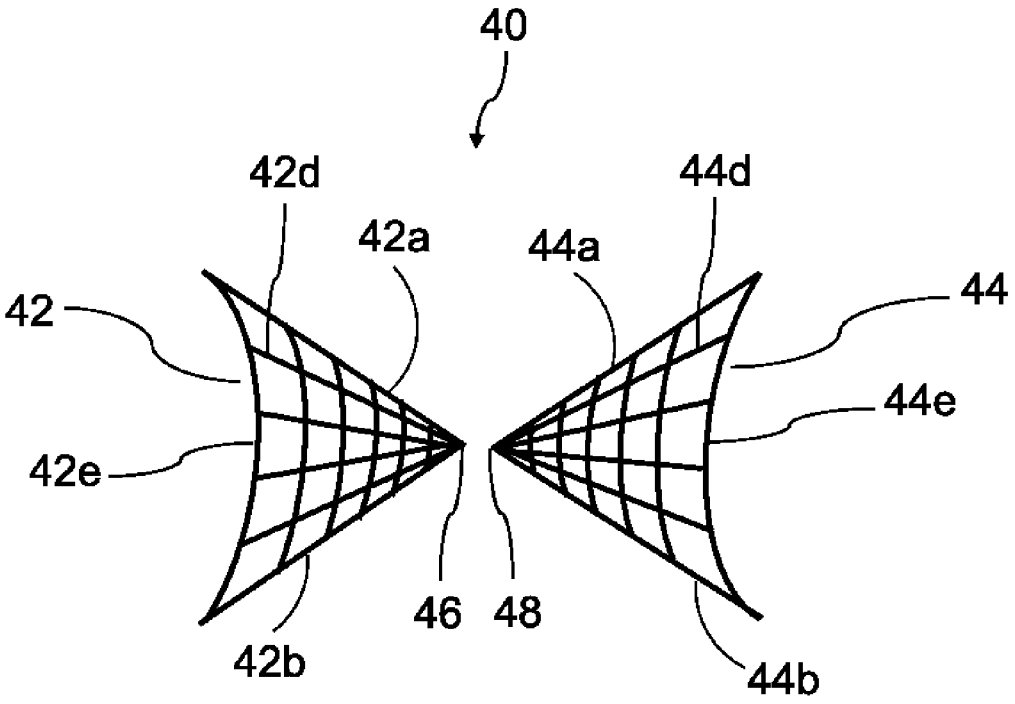
Figure 4C:
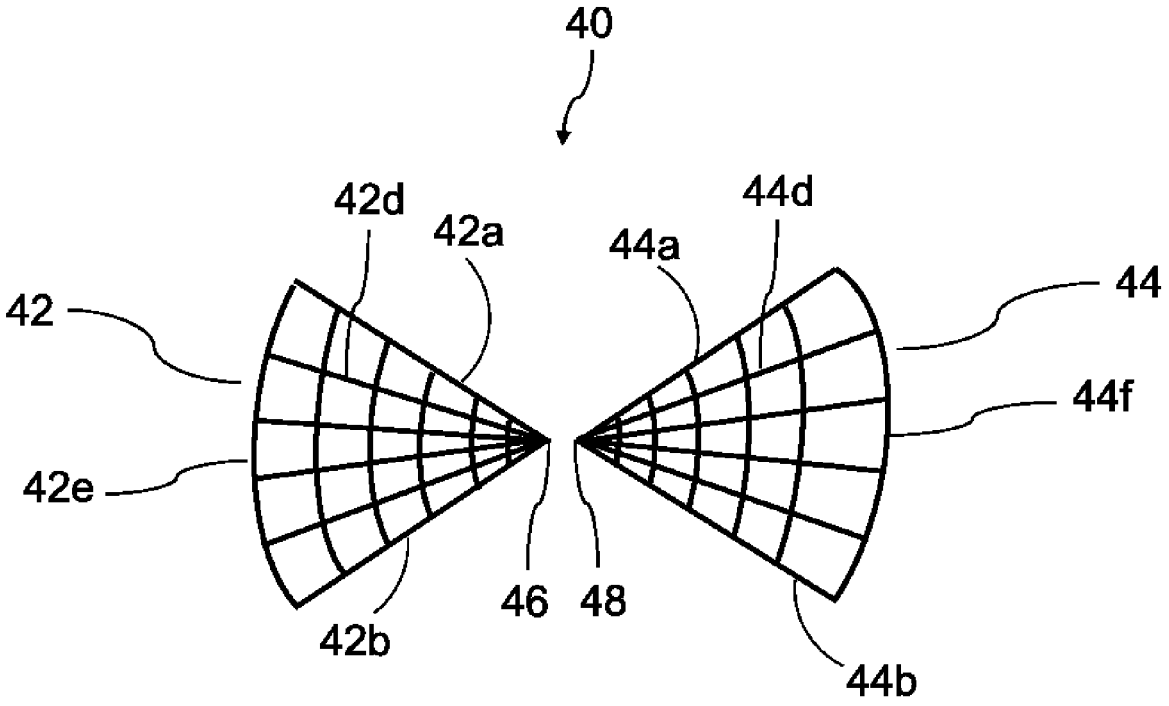

FIGS. 4A to 4C show various aspects of a planar bowtie antenna made of different types of linear elements. More specifically, in FIG. 4A, a top view of an antenna 40 is shown. Antenna 40 comprises a first arm 42 and a second arm 44, each comprising a first set of straight-linear edge elements 42*a*, 42*b*, and 42*c* and 44*a*, 44*b*, and 44*c*, respectively, which define a triangular-shaped periphery. In addition, arms 42, 44 each comprises a second set of straight-linear inner elements, such as elements 42*d* and 44*d*, respectively, which extend radially from either a feed point 46 or a feed point 48 and electrically couple to element 42*c* or element 44*c*. Furthermore, arms 42, 44 each comprises a third set of curvilinear inner elements, such as elements 42*e* and 44*e*, respectively, which are convex with respect to feed points 46, 48 and electrically couple element 42*a* to element 42*b* or element 44*a* to element 44*b*. In the arrangement shown in FIG. 4A, the curvilinear elements forming either arm 42 or arm 44, such as elements 42*e* and 44*e*, respectively, are substantially parallel to each other.

In particular, FIG. 4B, shows a top view of an alternative configuration of antenna 40 as described in FIG. 4A, in which linear elements 42*c* and 44*c* have been removed and each of the second set of straight-linear elements, such as elements 42*d* and 44*d*, electrically couple to curvilinear elements, such as elements 42*e* and 44*e*, and extend from feed points 46, 48 to elements 42*e* and 44*e*, respectively. Likewise, FIG. 4C shows a top view of yet another alternative configuration of antenna 40 as described in FIG. 4B, in which the convexity of curvilinear elements, such as elements 42*f* and 44*f*, has been reversed as compared to curvilinear elements, such as elements 42*e* and 44*e*, in FIG. 4B. In other words, in FIG. 4C curvilinear elements, such as elements 42*f* and 44*f*, are concave with respect to feed points 46, 48. In the configurations depicted in FIGS. 4B and 4C, the elements 42*e* and 44*e* located the farthest from feed points 46, 48 constitute edge elements of arms 42, 44, respectively.

Those skilled in the art will recognize that multiple combinations of straight-linear, curvilinear, or non-linear elements with different orientations and levels of convexity or concavity to the antenna feed points may be realized to create a set of adaptive-spaced elements to potentially form a grid. In addition, one or more of these elements may be uniformly or variably spaced or have a unique or variable width. Particularly, in applications where an antenna is installed in visible locations, such as on transparent glass, or include an impedance matching network, a balanced-to-unbalanced (BALUN) transmission line conversion system, or a noticeable transmission line, additional elements may be incorporated to improve the antenna visual appealing. More specifically, aesthetic elements may be integrated with a functional antenna layout for aesthetic improvement without affecting the antenna performance. For example, additional elements may include electrically coupled to or non-coupled to antenna conductive elements, non-conductive elements, and colored or theme-distinctive elements.

Figure 5A:
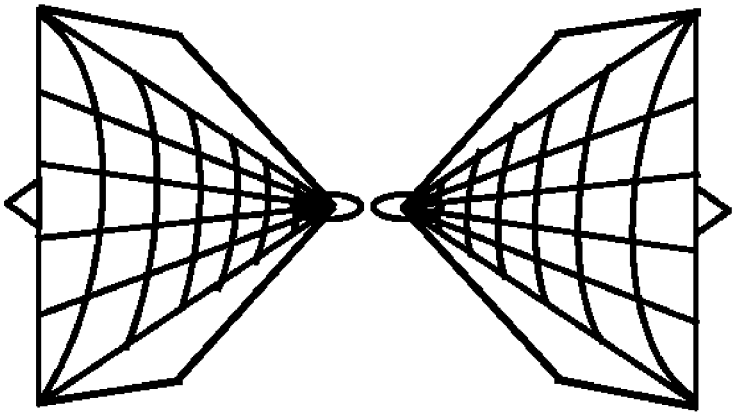
FIGS. 5A to 5E show various aspects of a planar bowtie antenna integrated with aesthetic elements.
Figure 5B:
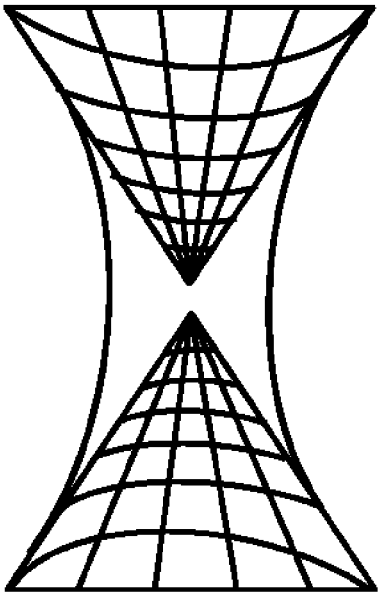

FIGS. 5A to 5E show various aspects of a planar bowtie antenna integrated with aesthetic elements to improve the antenna appearance. In particular, FIG. 5A shows an alternative configuration of antenna 40, as described in FIG. 4A, by integrating a combination of straight-linear and curvilinear elements with antenna 40 to resemble two head-to-head aircrafts. On the other hand, FIG. 5B shows another configuration of antenna 40, as described in FIG. 4A, by integrating a combination of curvilinear elements with antenna 40 to resemble a sand clock.

Figure 5C:
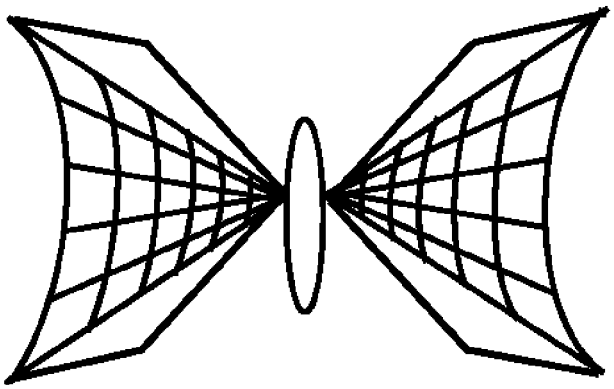
Figure 5D:
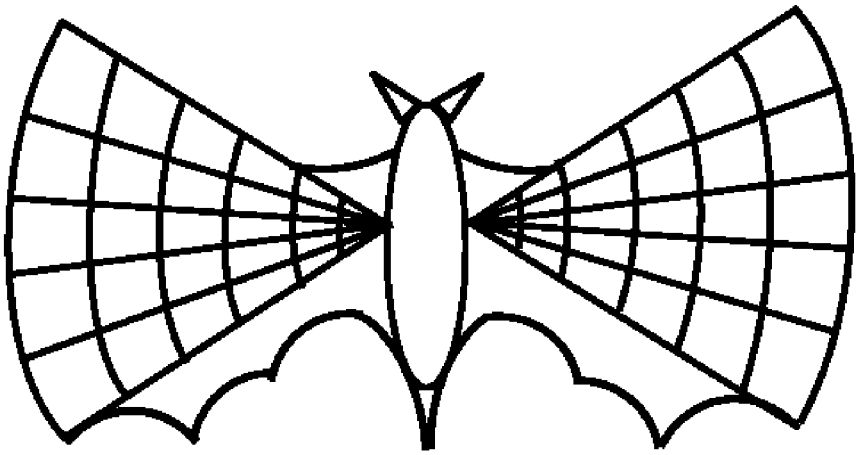
Figure 5E:
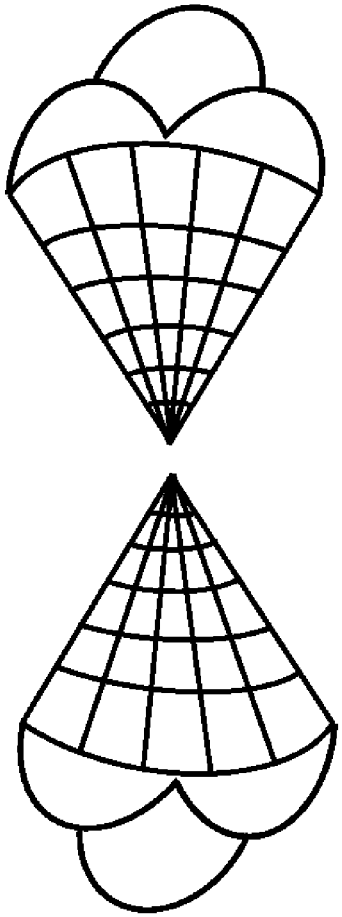

FIG. 5C shows an alternative configuration of antenna 40, as described in FIG. 4B, by integrating a combination of straight-linear and curvilinear elements with antenna 40 to resemble a butterfly. Likewise, FIGS. 5D and 5E show other configurations of antenna 40, as described in FIG. 4C. More specifically, FIG. 5D, integrates a combination of straight-linear and curvilinear elements with antenna 40 to resemble a bat. In particular, FIG. 5E integrates a combination of curvilinear elements with antenna 40 to resemble two back-to-back ice cream cones. Preferably, in reference to FIGS. 5A to 5E, the additional straight-linear and curvilinear elements integrated with antenna 40 are made of a non-conductive material and do not electrically couple to antenna 40.

Figure 6A:
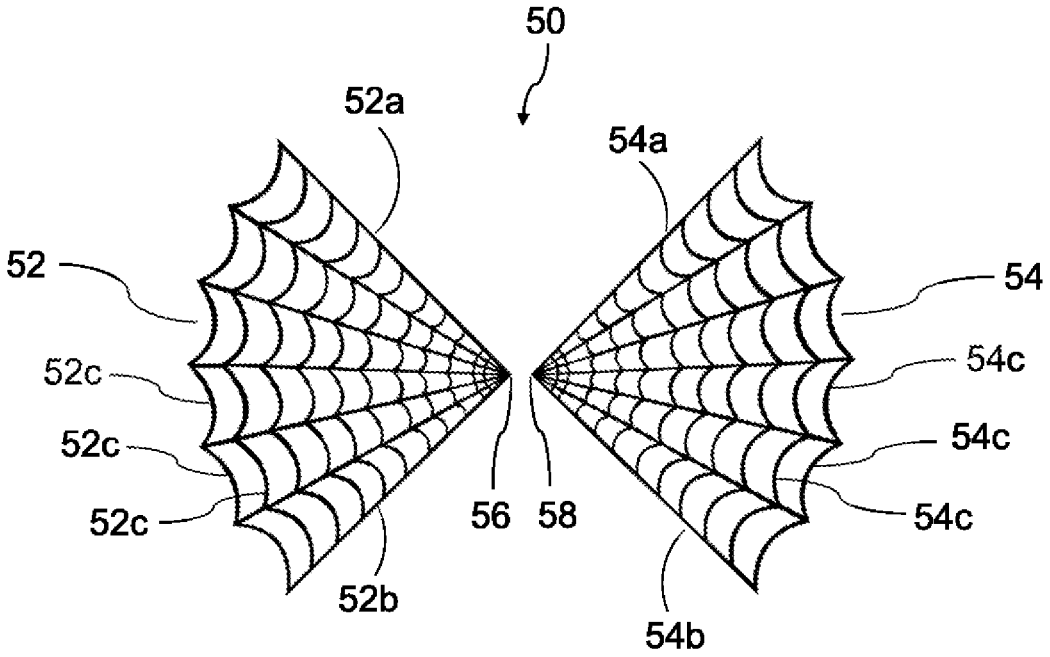
FIGS. 6A and 6B show various aspects of a planar, spider-web bowtie antenna.
Figure 6B:
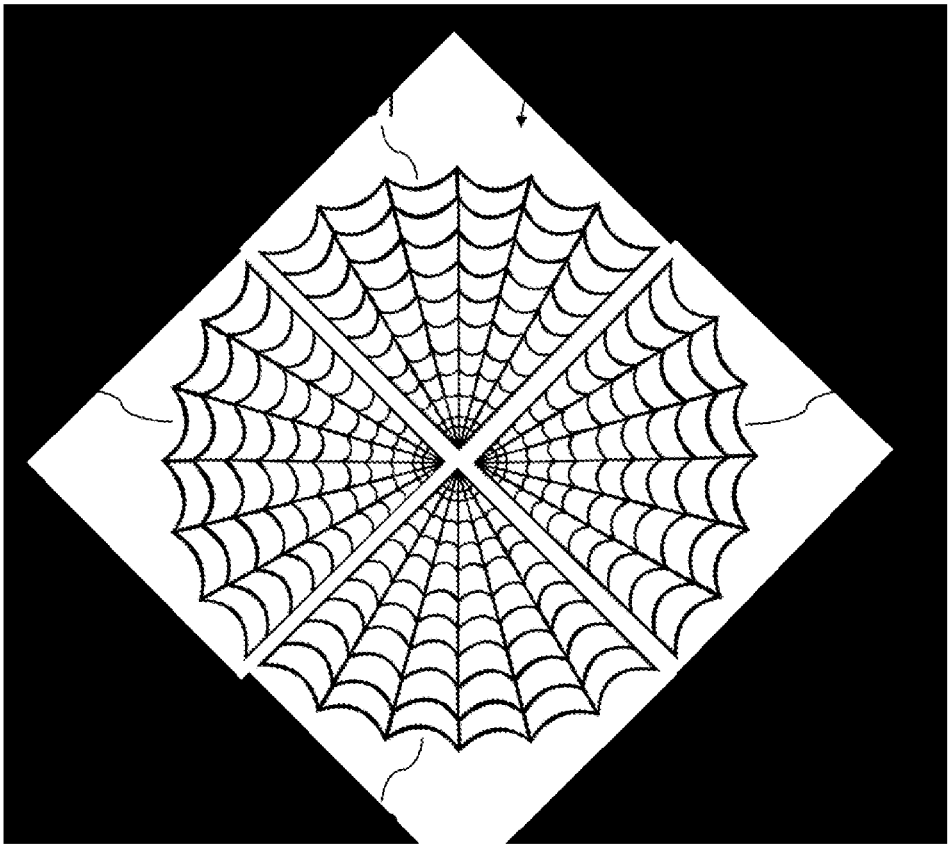

FIGS. 6A and 6B show various aspects of a planar bowtie antenna configured to resemble a spider-web to improve the antenna appearance. Specifically, in FIG. 6A, antenna 50 comprises a first arm 52 and a second arm 54, each comprising a first set of elements which are straight-linear, such as elements 52*a*, 52*b* and 54*a*, 54*b*, respectively, which extend radially from either a feed point 56 or a feed point 58.

Furthermore, arms 52, 54 each comprises a second set of elements, which are curvilinear, such as elements 52*c* and elements 54*c*, respectively, and are convex with respect to feed points 56 and 58. A number of elements 52*c* are electrically coupled between each other at one end, such that elements 52*c* form a chain that electrically couples at a first end to element 52*a* and at a second end to element 52*b*, while such chain of elements 52*c* maintains a substantially same distance to feed point 56. Likewise, a number of elements 54*c* are electrically coupled between each other at one end, such that elements 54*c* form a chain that electrically couples at a first end to element 54*a* and at a second end to element 54*b*, while such chain of elements 54*c* maintains a substantially same distance to feed point 58. Moreover, elements 52*a*, 54*a* and 52*b*, 54*b* along with the elements 52*c*, 54*c* located the farthest from feed points 56, 58 constitute edge elements of arms 52, 54, respectively.

In the arrangement shown in FIG. 6A, each of arms 52, 54 resembles a structure of a spider web section, and the curvilinear elements, such as elements 52*c* and 54*c*, within two adjacent straight-linear elements, are substantially parallel to each other. Thus, a bowtie antenna formed by two arms, each having a spider-web design may be used for improving aesthetics without degrading antenna performance.

FIG. 6B shows antenna 60, comprised of antenna 50, as described in FIG. 6A; a first spider-web design, non-functional arm 51; and a second spider-web design, non-functional arm 53. Preferably, arms 51, 53 are not coupled to arms 52 and 54. More preferably, the appearance of arms 51, 53 is very similar to the appearance of arms 52, 54. Most preferably, arms 51, 53 are made of non-conductive material. As a result, a bowtie antenna having a full spider-web structure may be implemented. Those skilled in the art will recognize that arms 51, 53 may also form a second functional bowtie antenna or to couple and operate in combination with antenna 50.

Figure 7:
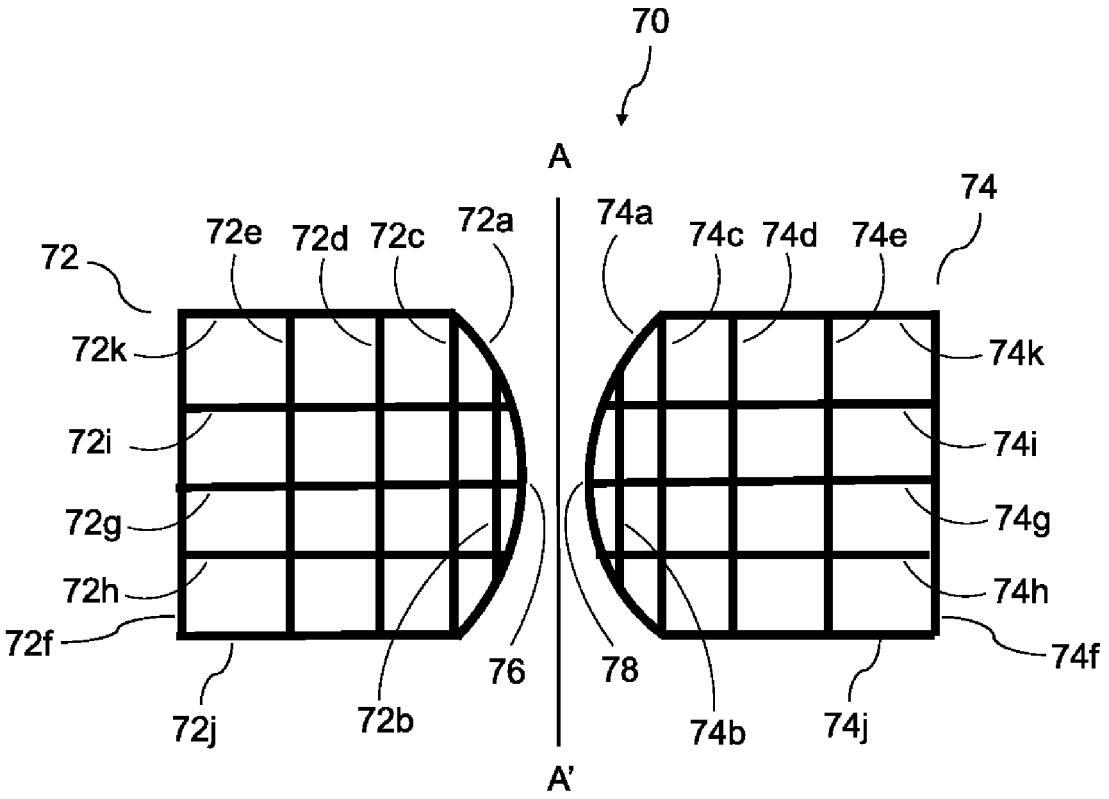
FIG. 7 shows a top view of a planar antenna with linear elements having a variable spacing.

In yet another configuration, FIG. 7 shows a top view of an antenna 70, comprising a first arm 72 and a second arm 74. Each arm 72, 74 comprises a curvilinear element 72*a* and 74*a*, respectively, which are convex with respect to each other. Element 72*a* originates from a feed point 76, whereas element 74*a* originates from a feed point 78. Preferably, each feed point 76 and 78 is located at a midpoint between the ends of curvilinear element 72*a* and 74*a*, respectively. Each element 72*a*, 74*a* describes a curve that can be approximated by a quadratic function, wherein feed points 76, 78 correspond to the unique global extreme value (maximum or minimum) of such quadratic function. Each arm 72, 74 further comprises a first set of straight-linear elements, such as 72*b* and 74*b*, respectively, which are substantially parallel to axis AA', and a second set of straight-linear elements, such as 72*g* and 74*g*, respectively, which are substantially perpendicular to axis AA'.

In this particular configuration, arm 72 and arm 74 are mirror images of each other with respect to an imaginary axis AA' equidistant from and not containing feed points 76 and 78. Feed points 76 and 78 are separated by approximately 1.5 mm, which corresponds to the minimum separation between arm 72 and arm 74. Furthermore, arms 72, 74 each comprises a first set of five straight-linear elements 72*b*, 72*c*, 72*d*, 72*e*, 72*f* and 74*b*, 74*c*, 74*d*, 74*e*, 74*f*, respectively, and a second set of five straight-linear elements 72*g*, 72*h*, 72*i*, 72*j*, 72*k* and 74*g*, 74*h*, 74*i*, 74*j*, 74*k*, respectively. Each element 72*b* to 72*e* and 74*b* to 74*e* is substantially parallel to axis AA'. On the contrary, each element 72*g* to 72*k* and 74*g* to 74*k* is substantially perpendicular to axis AA'.

Furthermore, elements 72*a*, 72*f*, 72*j*, and 72*k* constitute edge elements of arm 72, whereas elements 74*a*, 74*f*, 74*j*, and 74*k* constitute edge elements of arm 74. Correspondingly, elements 72*b*, 72*c*, 72*d*, 72*e*, 72*g*, 72*h*, and 72*i* constitute inner elements of arm 72, whereas elements 74*b*, 74*c*, 74*d*, 74*e*, 74*g*, 74*h*, and 74*i* constitute inner elements of arm 74. Each element 72*a* to 72*k* and 74*a* to 74*k* has a width of about 0.5 mm.

Moreover, straight-linear elements 72*g* to 72*k* of arm 72 are uniformly spaced by approximately 45 mm. Likewise, straight-linear elements 74*g* to 74*k* of arm 74 are uniformly spaced by approximately 45 mm. On the other hand, the approximate spacing between elements 72*b*, 74*b* and 72*c*, 74*c* is 30 mm, between elements 72*c*, 74*c* and 72*d*, 74*d* is 40 mm, between elements 72*d*, 74*d* and 72*e*, 74*e* is 50 mm, and between elements 72*e*, 74*e* and 72*f*, 74*f* is 60 mm. The spacing from feed points 76, 78 to elements 72*b*, 74*b*, respectively, is about 20 mm. The maximum separation between a point on element 72*a* and its corresponding mirror image on element 74*a* is about 95 mm. The dimensions of antenna 70 are suitable for operating in the 174 MHz to 806 MHz frequency range, corresponding to a High-Definition TV application.

According to the various configurations of the invention, those skilled in the art will realize that a large number of shapes, including geometrical shapes, animals, hearts, wings, flowers, trees, buildings, and landscapes may be designed using a basic layout of a bowtie antenna. Moreover, alternative antennas such as a dipole, monopole, spiral, helical, and others may be arranged individually, combined, or as an array to be used as a basic design layout, depending on the specific antenna application. Likewise, other types of aesthetic elements or antenna elements either planar or non-planar, using dielectric or conductive materials either electrically coupled or uncoupled, may be utilized. The integration of a basic antenna layout and aesthetic elements may be fabricated by tracing all the corresponding antenna elements on a single substrate, as well known in the art. The substrate may be part of a structure in which the antenna would be installed, such as a building, a door or a window, or comprise a label or decal to be affixed to such structure. Likewise, the aesthetic elements may all be fabricated in a different substrate to be affixed, as a label or decal, to the location where the antenna has been or would be installed.

In reference to each of the above-described configurations of the invention, a method for designing an antenna having adaptively-spaced elements defines dimensional and relative positioning parameters of such elements and the use of dielectric materials or other conductive materials that may reduce the amount of material, cost, weight, and obtrusiveness of the antenna, while not significantly affecting or potentially improving the antenna performance. The method subject of the present invention may be performed according to the following steps:

1. Identifying the structural location where the antenna would be installed to determine substrate type and characteristics, available area, and surrounding factors capable of affecting the antenna operation.
2. Designing an antenna, made of solid conductive material, to operate installed in the location identified in step 1, according to the operational requirements.
3. Evaluating and recording the performance of the antenna designed in step 2.
4. Approximating the solid conductive material comprising the antenna designed in step 2 by a number of parallel straight-linear and or parallel curvilinear antenna elements uniformly-spaced, wherein the spacing between adjacent parallel elements is no larger than ten percent of a wavelength corresponding to the maximum frequency (minimum wavelength) of operation of the antenna.
5. Evaluating and recording the performance of the antenna designed in step 4.
6. Comparing the performance of the antenna designed in step 4 and the performance of the antenna designed in step 2 to determine a margin of performance difference.
7. Adjusting the dimensions of the antenna designed in step 4, until the performance of the dimensionally-adjusted antenna is within an acceptable margin compared to the performance of the antenna designed in step 2 or a predetermined criterion, by implementing one or more of the following approaches:
   - 7.1 Experimentally by trial and error, while measuring key performance indicators of said antenna (e.g. gain, radiation efficiency, polarization, input impedance, etc.).
   - 7.2 By performing simulations using a computational tool, such as an electromagnetic software.
8. Selecting a profile to adaptively adjust the spacing between the antenna elements, such that the number of elements and amount of conductive material used is reduced as compared to the antenna designed in step 4.
9. Adjusting the dimensions of the antenna designed in step 8, if necessary, until the performance of the dimensionally-adjusted antenna is within an acceptable margin compared to the performance of the antenna designed in step 2 or a predetermined criterion, by implementing one or more of the following approaches:
   - 9.1 Experimentally by trial and error, while measuring key performance indicators of said antenna (e.g. gain, radiation efficiency, polarization, input impedance, etc.).
   - 9.2 By performing simulations using a computational tool, such as an electromagnetic software.
   - 9.3 By optimizing the size and location of the antenna elements with or without the addition of dielectric or conductive aesthetic elements that may or may not couple to such antenna elements, according to a predefined set of performance factors.
10. Evaluating performance results from step 9 to identify the most suitable structure or combination of structures to determine dimensional and operational parameters of the adaptive-spacing antenna.

Those skilled in the art will recognize that the steps above indicated can be correspondingly adjusted for specific antenna element configurations and other constraints such as antenna dimensions, conformality, obtrusiveness, operating frequency, bandwidth, operational conditions, number of antennas, and surrounding environment as well as available area and location for implementation of each antenna in a particular device for a specific application.

The method and different configurations of the adaptive-spacing antenna and a design method thereof have been described herein in an illustrative manner, and it is to be understood that the terminology which has been used is intended to be in a descriptive rather than in a limiting nature. Any embodiment herein disclosed may include one or more aspects of the other embodiments. The exemplary embodiments were described to explain some of the principles of the present invention so that others skilled in the art may practice the invention. Those skilled in the art will recognize that many modifications and variations of the invention are possible in light of the above teachings. The present invention may be practiced otherwise than as specifically described within the scope of the appended claims and their legal equivalents.

What is claimed is:

1. An antenna comprising a first arm, said first arm comprising: a plurality of conductive edge elements having a shape selected from the group consisting of a straight-linear element and a curvilinear element; a plurality of conductive inner elements having a shape selected from the group consisting of a straight-linear element and a curvilinear element; a substantially planar and non-conductive substrate; at least one feed point; and a transmission line to couple said at least one feed point to an electronic device; wherein said first arm is disposed on said substantially planar and non-conductive substrate; wherein said plurality of edge elements define a periphery of said antenna and said plurality of conductive inner elements are circumscribed within said periphery; wherein at least one of said plurality of conductive edge elements is electrically coupled to said at least one feed point; wherein said plurality of conductive edge elements and said plurality of conductive inner elements are physically and electrically coupled at a plurality of coupling points and disposed to form a non-uniform grid having an adaptive spacing within an area delimited by said periphery; and wherein said adaptive spacing comprises an increase of at least a gap between two adjacent and physically uncoupled elements of said plurality of conductive inner elements, as a distance between the farthest of said two adjacent and physically uncoupled elements of said plurality of conductive inner elements to said at least one feed point increases.

2. The antenna of claim 1, wherein said adaptive-spacing follows a profile represented by at least one portion of a mathematical function selected from the group consisting of a polynomial, sinusoidal, raised-cosine, Kaiser, Hamming, Bartlett, Gaussian, Hanning, Blackman, and Flat-top functions.

3. The antenna of claim 1, wherein at least two of said plurality of conductive inner elements are substantially parallel.

4. The antenna of claim 3, wherein said adaptive spacing comprises an increase of at least a gap between two adjacent elements of said plurality of substantially parallel conductive inner elements, as a distance between the farthest of said two adjacent, substantially parallel conductive inner elements to said at least one feed point increases.

5. The antenna of claim 1, further comprising a second arm, wherein said second arm is a mirror image of said first arm.

6. The antenna of claim 5, wherein an imaginary axis connecting said at least one feed point of said first arm and said at least one feed point of said second arm bisects both said area delimited by said periphery of said first arm and said area delimited by said periphery of said second arm and wherein said second arm is disposed on said substantially planar and non-conductive substrate.

7. The antenna of claim 6, wherein said periphery of said area delimited by said first arm and said periphery of said area delimited by said second arm resemble a periphery of a bowtie antenna.

8. The antenna of claim 1, wherein said plurality of conductive edge elements and said plurality of conductive inner elements comprise at least one item selected from the group consisting of wires, strips, and plates.

9. The antenna of claim 1, wherein a first end of each of at least two of said plurality of conductive edge elements is electrically coupled to said at least one feed point and wherein a second end of each of said at least two of said plurality of conductive edge elements diverge from said at least one feed point.

10. The antenna of claim 1, wherein said periphery defines a fully enclosed area.

11. The antenna of claim 1, further comprising a substantially non-conductive structure to provide an aesthetic appealing.

12. The antenna of claim 11, wherein said structure for aesthetic appealing comprises at least one shape selected from the group consisting of geometrical, animals, hearts, wings, flowers, trees, buildings, and landscapes shapes.

13. The antenna of claim 1, wherein at least a portion of said transmission line is part of a structure to provide an aesthetic appealing.

14. The antenna of claim 1, wherein said plurality of conductive edge elements and said plurality of conductive inner elements are disposed within said periphery, according to an expected polarization characteristics of operation of said antenna.

15. The antenna of claim 1, further comprising at least one component selected from a group consisting of an impedance matching network, an active electronic device, a passive electronic device, a filter, and a balanced-to-unbalanced (BALUN) transmission line conversion system.

16. The antenna of claim 1, wherein said substrate is part of a building.

17. The antenna of claim 1, wherein said substrate is substantially transparent to light.

* * * * *